US005664979A

United States Patent [19]

Benham

[11] Patent Number: 5,664,979

[45] Date of Patent: Sep. 9, 1997

[54] PIVOTING FIN FOR WATERCRAFT

[76] Inventor: Roger A. Benham, P.O. Box 830, San Diego, Calif. 92112

[21] Appl. No.: 712,959

[22] Filed: Sep. 12, 1996

Related U.S. Application Data

[63] Continuation of Ser. No. 534,555, Sep. 27, 1995, abandoned.

[51] Int. Cl.[6] ..... B63B 1/00

[52] U.S. Cl. ..... 441/79; 114/136; 114/140

[58] Field of Search ..... 441/74, 79; 114/39.2, 114/132–143

[56] References Cited

U.S. PATENT DOCUMENTS

| | | | |
|---|---|---|---|
| 731,227 | 6/1903 | Royse | 114/143 |
| 3,516,100 | 6/1970 | Ellis | 441/79 |
| 3,972,300 | 8/1976 | Adamski | 114/143 |
| 4,686,922 | 8/1987 | Burroughs | 114/140 |
| 4,923,427 | 5/1990 | Roland | 114/140 |
| 5,273,472 | 12/1993 | Skedeleski et al. | 441/79 |

FOREIGN PATENT DOCUMENTS

| | | | |
|---|---|---|---|
| 0264279 | 4/1988 | European Pat. Off. | 441/79 |
| WO 88/09286 | 12/1988 | WIPO | 114/132 |
| WO 91/17080 | 11/1991 | WIPO | 441/79 |

*Primary Examiner*—Edwin L. Swinehart
*Attorney, Agent, or Firm*—Baker, Maxham, Jester & Meador

[57] ABSTRACT

A watercraft hull having a lower surface for normal contact with a body of water includes a fin having an inner end secured to the lower surface for extending into a body of water, a hinge intermediate the inner and outer ends for enabling an outer portion of the fin to pivot about the longitudinal axis of the watercraft for enabling increased controllability and performance of the watercraft.

19 Claims, 3 Drawing Sheets

PIVOTING FIN FOR WATERCRAFT

This application is a continuation of application Ser. No. 08/534,555, filed Sep. 27, 1995, now abandoned.

BACKGROUND OF THE INVENTION

The present invention relates to watercraft and pertains particularly to an improved fin for surfboards and other small watercraft.

Many watercraft, particularly surfboards, windsurf boards, and sailboats use a fin to resist side slip as a result of transverse forces on the craft. The transverse forces may be applied to the watercraft from many sources such as wind, traversing the slope of a wave and executing a turn. When a surfboard is traversing a wave, the fin extends into the water and helps resist and/or prevent side slip of the board on the face of the wave. Because the board is at an angle to the surface of the wave, the fin frequently has very little of its length in the water. The result is that the net effective area of the fin is decreased.

When a conventional fixed fin surfboard is turning, as illustrated in FIG. 1, the rail toward the turn (left) dips down and the board 12 is tilted resulting in the fin 14 extending at an angle to the water surface and presenting less area to resist lateral forces. This results in the fin becoming less effective in resisting the lateral forces. The effective area of the fin can be expressed by the formula n=d sine $\phi$. Where n is a major component of the area of the fin, d is depth or length of the fin and $\phi$ is the angle of the fin. Thus, the effective area component n of the fin is decreased when the board is in a turn making it less effective in the turn. The force F on the fin is directly proportional to the effective fin area and is therefore reduced when in a turn. The same thing occurs when a sailboard or sailboat keels over under the force of the wind.

It is therefore desirable to have a fin that is more effective in a turn or heel condition of the craft.

SUMMARY OF THE INVENTION

It is therefore a primary object of the present invention to provide an improved fin that is more effective in a turn or heel condition of a craft.

In accordance with a primary object of the present invention, a watercraft keel is provided with hinge means or flexing means to enable the keel or fin to remain highly effective during tilting or heeling of the craft about its longitudinal axis.

BRIEF DESCRIPTION OF THE PREFERRED EMBODIMENTS

The above and other objects and advantages of the present invention will become apparent from the following description when read in conjunction with the accompanying drawings wherein.

DETAILED DESCRIPTION OF THE PREFERRED EMBODIMENTS

Figure 2:
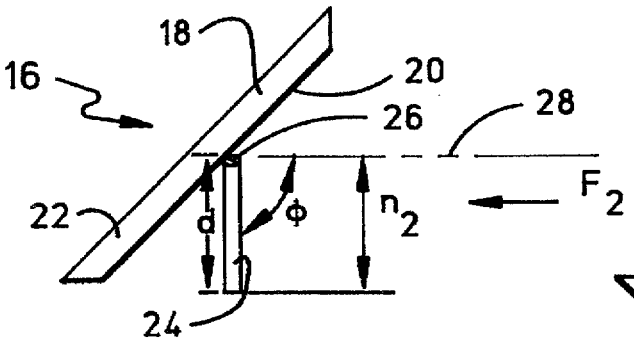
FIG. 2 is a view like FIG. 1 of a preferred embodiment of the present invention.

Referring now to FIG. 2 of the drawings an exemplary preferred embodiment of the present invention is illustrated and designated generally by the numeral 16. As illustrated, a surfboard 18 forms a three-dimensional buoyant body for supporting another body, such as a human body, on a body of water. The surfboard is a special form of a water craft having a hull with a bottom surface 20 formed for contact with the surface of the body of water, 28, and having a deck 22, usually somewhat planar in configuration for supporting a surfer for traversing and sliding down the face of a wave in a body of water. In accordance with the present invention, a fin 24 is mounted to the undersurface 20 of the surfboard 18 with a pivot, hinging, or flexing member at 26 enabling the fin to pivot or swing through an angle Phi($\phi$) which may be on the order of up to about 90°.

Figure 1:
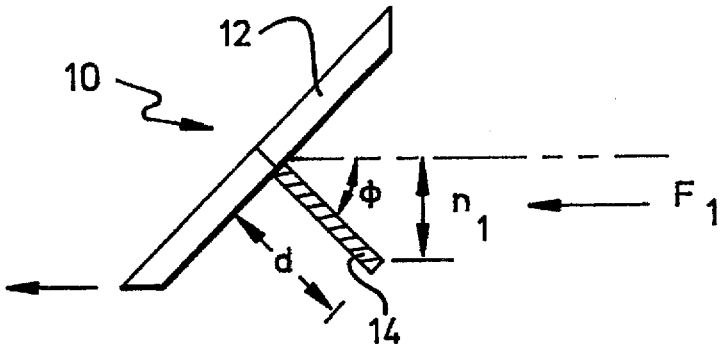
FIG. 1 PRIOR ART
FIG. 1 is a front elevation view of an exemplary prior art surfboard and fin.

The surfboard 18 is illustrated in the same position and orientation in a turn to the left as that of the conventional board of the prior art, as illustrated in FIG. 1. The board is in a turn to the left with the result that the force acting on the fin 24 is in a direction to the left, as shown by the arrow $F_2$. The arrow $F_2$ represents a force $F_2$ calculated using the major component described by the formula as described above in the background of the invention. As will be apparent from viewing FIGS. 1 and 2, the force $F_2$ for the board of the present invention will be greater than that of $F_1$ of the board of the prior art. Thus, the fin 24 in accordance with the invention provides a greater force acting on the craft 18 reacting to and resisting against the outside of the turn. The pivoting or flexing of the fin to the vertical orientation presents a larger area of it to the body of water to resist side slippage of the board.

Figure 3:
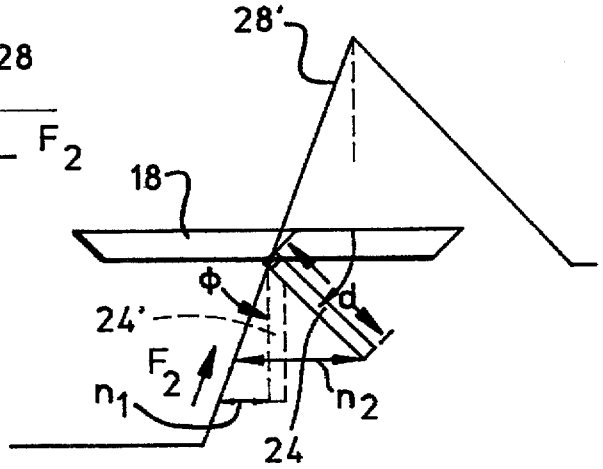
FIG. 3 is a view like FIG. 2 of the embodiment of FIG. 2 on the front side of a wave.

Referring to FIG. 3 of the drawings, the surfboard 18 is illustrated moving down but attempting traversing the front face of a wave formed by the body of water 28'. The fin 24 of the board is pivoted to the right as illustrated so that the maximum area of the board resists the lateral and downward movement of the board by the force $F_2$ of the body of water. The effective area of fin 24 is $n_2$ as opposed to $n_1$ for a fixed fin.

For the purposes of comparing with a fin of the prior art, a phantom fin 14' is illustrated extending vertically downward from the surface of the surfboard 18. As can be seen, the effective area $n_2$ on the board of the fin 24 of the present invention exceeds the effective area $n_1$ of the fin of the prior art by a considerable margin. This provides greater resistance of the surfboard 18 to lateral movement down the face of the water surface 28'.

Figure 4:
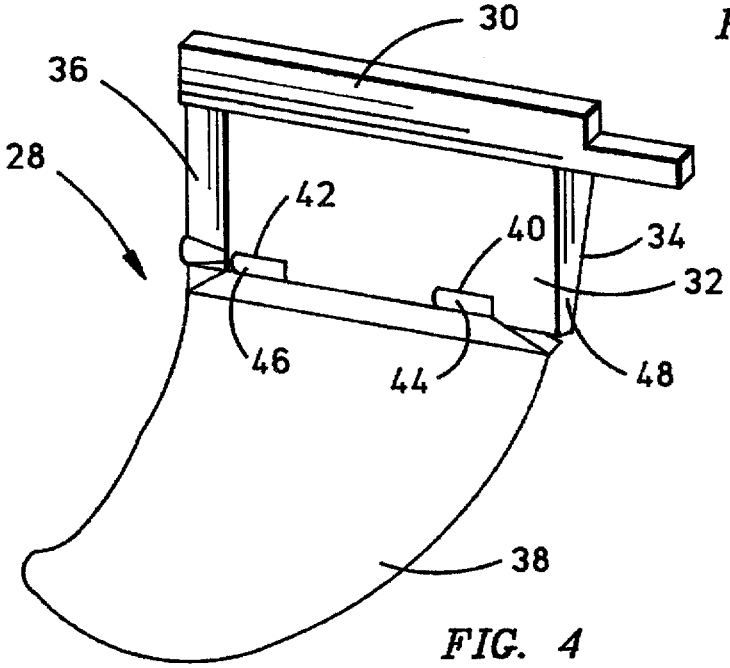
FIG. 4 is a detailed perspective view of an alternate embodiment of the invention.

Referring to FIG. 4 of the drawings, a more detailed exemplary embodiment of a surfboard fin in accordance with the invention is illustrated and designated generally by the numeral 28. The fin assembly includes a mounting base 30 adapted to fit and be mounted into a generally rectangular box-like slot or receptacle in the bottom of a surfboard. A first or fixed fin portion 32 extends from the base portion 30 typically at right angles or normal to the deck and bottom surface of the surfboard. This is a fixed section of the fin and may have a length predetermined by any number of factors, including the desired overall length of the fin. The fixed portion of the fin 32 may be sharpened, rounded or streamlined at its forward and trailing edges 34 and 36, respectively, to reduce the resistance of its movement through the water.

A pivoting fin section 38 having the usual fin configuration is pivotly hinged to the fixed member 32 at the outermost end of the hinged section freely pivot during use in either direction from a central position normal to said lower surface about an axis parallel to the longitudinal axis of the watercraft. A suitable hinge structure as illustrated includes a pair of slots 40 and 42 formed in the base fin 32 for receiving a pair of projecting tabs 44 and 46 from the pivoting section 38. An aligned bore extends through the outermost section of the fixed fin portion and through the extensions 44 and 46 of the pivoting fin section 38 for receiving an elongated hinge or pivot pin 48. Suitable stop means such as abutting shoulders on the pivoting part of the fin are provided to limit the degree of pivot of the fin relative to the fixed portion 32 and to the hull surface.

Figure 5:
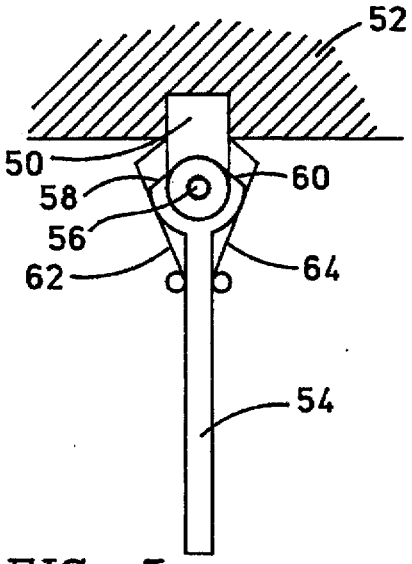
FIG. 5 is a front elevational view of a further embodiment of the invention.

Referring to FIG. 5, there is illustrated another modification of the invention wherein a base portion of the fin 50 is mounted in the usual manner in the body of a hull 52 with a pivoting fin 54 hinged as previously described at 56. The position of the hinge 56 relative to the surface of the hull varies as previously explained to provide various modifications in the effective area of the board as previously discussed. Also, multiple hinges or flex points can be used on a single fin assembly. The fin 54 includes shoulders 58 and 60 which engage side surfaces of the base member 50 for limiting the pivoting of the fin 54. These may be modified to provide any desired degree of maximum pivot from a neutral position.

An additional feature of the embodiment is the provision of resilient means in the form of opposing springs 62 and 64 which oppose the pivoting of fin 54. The resistance of the springs may be selected to obtain the desired resistance to pivoting to achieve the desired performance. The springs 62 and 64 may be of any suitable type such as leaf springs and may take any configuration. The springs are mounted or fixed at an inner end to the hull or the base of the fin and form fingers that extend along the side of the fin and engage at the outer ends with the sides of the fin.

Figure 6:
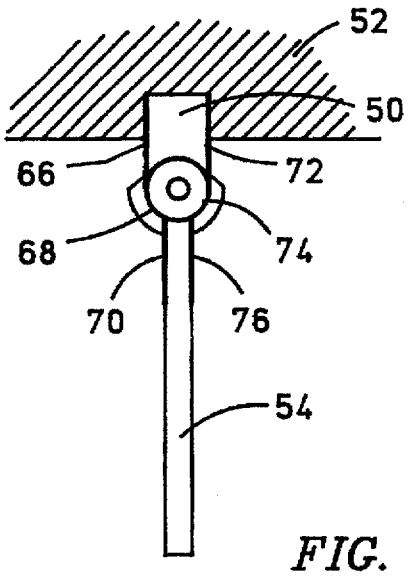
FIG. 6 is a view like FIG. 5 of another embodiment of the invention.
Figure 7:
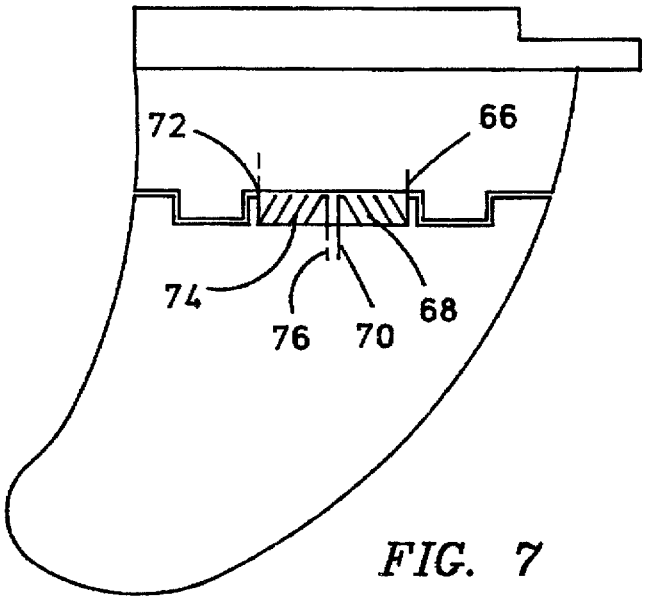
FIG. 7 is a side elevation view of the embodiment of FIG. 6.

Referring to FIGS. 6 and 7, it will also be apparent that coil springs of the torsional type may be may be utilized and mounted on or concentric with the pivot shaft 56, as shown in FIGS. 6 and 7. A pair of springs, each having an inner arm fixed to the hull or base of the fin and an outer arm engaging the side of the pivoting portion of the fin with an intermediate coil (not shown). For example, a first spring 68 has an inner arm 66 and an outer arm 70. A second spring 74 has an inner arm 72 and an outer arm 76. These outer arms bias against opposite sides of the fin biasing it to a central or neutral position.

The spring mechanism exerts a force biasing the fin toward a central position. The amount of force required to deflect the spring is determined by the spring material or spring constant. The fin is preferably normally stabilized in a central position. The degree of bias can be adjusted by selection of the spring stiffness. A stiffer spring renders the board more stiff. A softer spring renders the board more loose.

Figure 8:
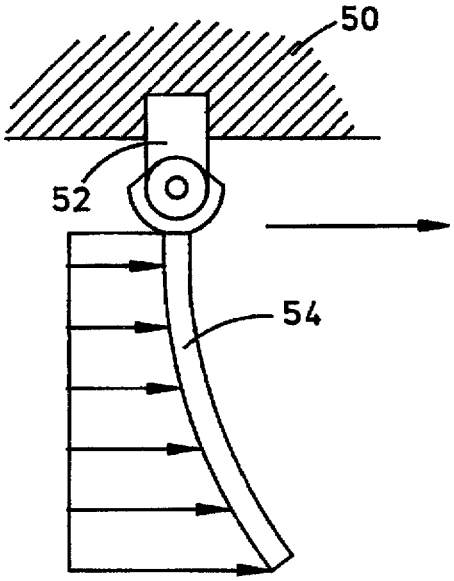
FIG. 8 is a view like FIG. 6 illustrating minor modifications.

As illustrated in FIG. 8, a certain amount of deflection may occur in the fin itself by the proper selection of stiffness of the fin material. Right or left uniform load created during a turn causes bending and deflection in accordance with traditional beam loading equations. Thus, the stiffness of the fin as a beam can be selected to provide a desired degree of stiffness or softness. As illustrated, the deflection will be greater at the outer end. It will also be apparent that the construction of the fin may be such that it may be locked in a selected angle relative to the hull surface.

Figure 9:
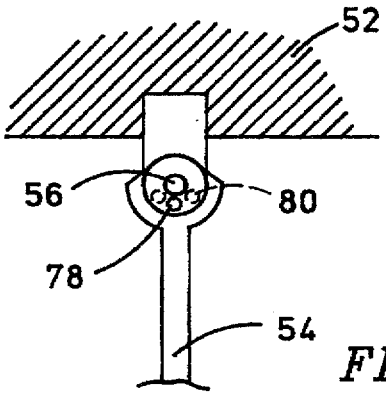
FIG. 9 is front a elevational view of a still further embodiment of the invention.

Referring to FIG. 9, for example, suitable clamping arrangements or pins may be utilized to clamp or fix the fin in a selected angular position relative to the hull. For example, as seen in FIG. 9, a pin 78 may be inserted in a bore extending through fin and base portions of the hinge structure parallel and offset from the hinge pin 56. Additional holes or bores 80 may be provided in the hinge portion of the fin itself so that selected angles may be selectively locked in. This would enable setting the fin at selective angles depending on wind, wave or other conditions.

Figure 10:
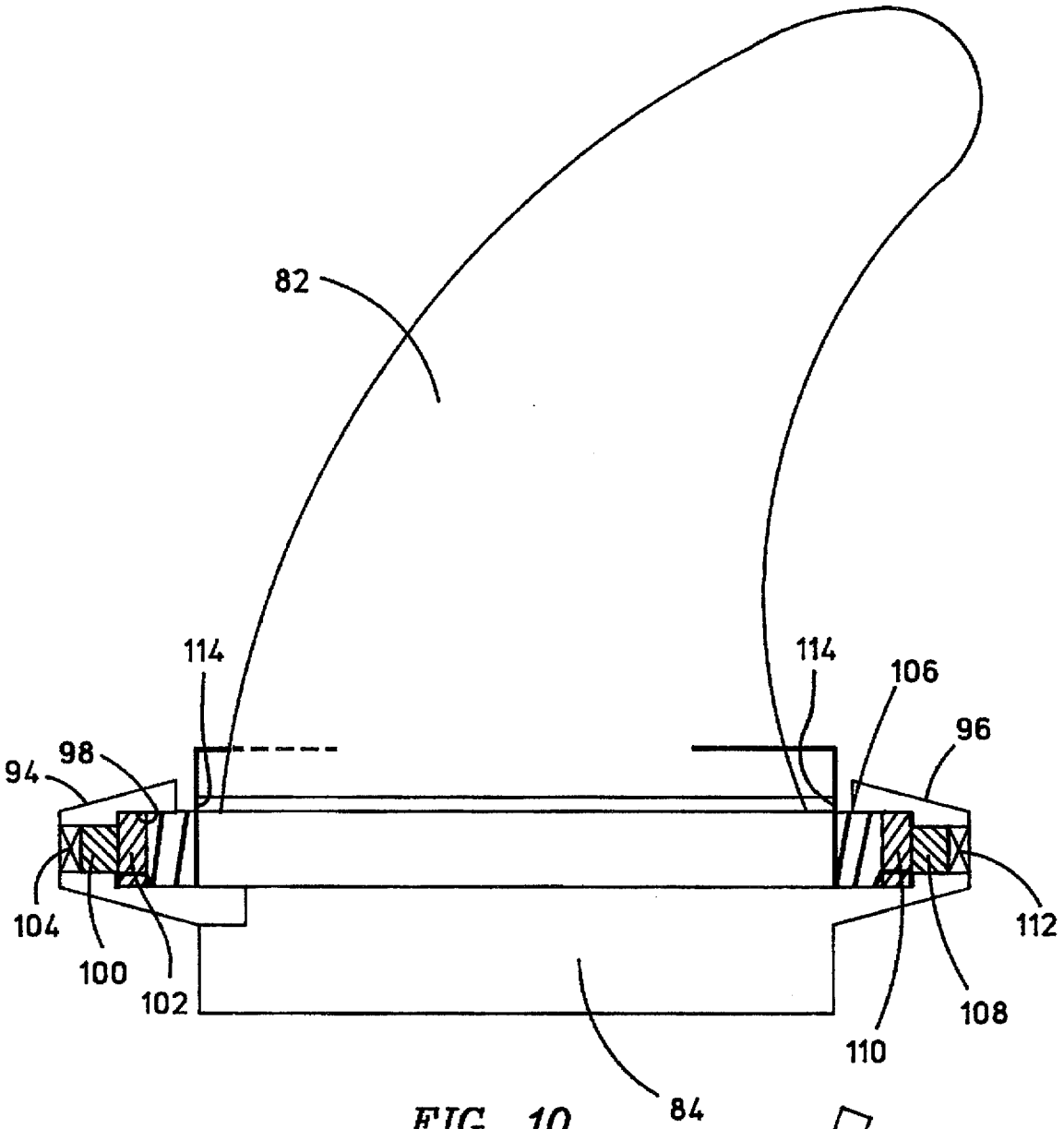
FIG. 10 is a side elevation view of still another embodiment of the invention.
Figure 12:
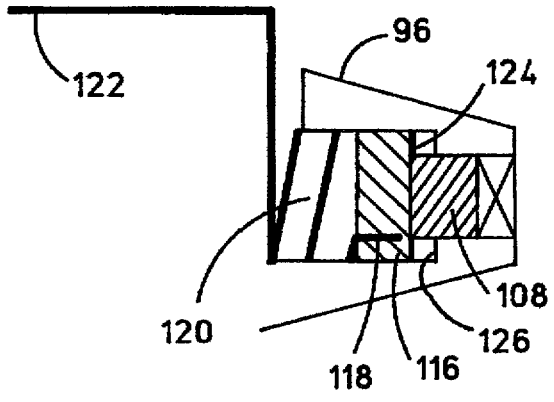
FIG. 12 is a detailed view of the tension adjuster of FIG. 10.
Figure 11:
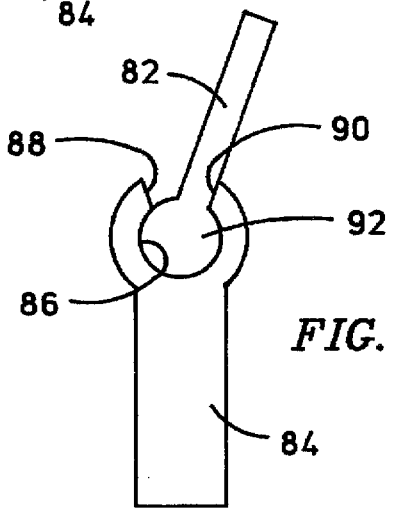
FIG. 11 is a detail view of a portion of the embodiment of FIG. 10.

Referring to FIGS. 10 through 12, another resiliently pivoting fin embodiment is illustrated. In this embodiment a fin 82 is pivotally mounted in a base 84 by means of a special hinge as illustrated with details in FIG. 11. The hinge comprises an open bore 86 formed with a slot defined by side walls or shoulders 88 and 90 along an edge of the base. The fin is formed along its upper or connected edge with a cylindrical member 92 defining a hinge pin for fitting into the bore 86 as illustrated in FIG. 11. The terminal ends of the bore 86 extend to journal like members 94 and 96, which house tension adjusting mechanisms. One of these members, 94, is preferably detachable to enable insertion of the hinge pin 92 into the bore. The member 94 includes a stepped bore 98 in which is mounted a bolt-like shaft member 100 having a head 102 on one end and a screw driver slot 104 on the other. The other member similarly has a stepped bore 106 in which is mounted a bolt-like shaft member 108 having a head 110 on one end and a screwdriver slot 112 on the other. A pair of torsion coil springs 114 are connected to each of the bolt members and to opposite sides of the fin 82.

Referring to FIG. 12, the shaft head 110 has an eccentric slot 116 for receiving and coupling to one end 118 of spring 114. The spring has an intermediate coil portion 120 between end 118 and an opposite outward extending arm 122 on the opposite end which engages and applies bias to the fin. The back of the head 110 has a latching surface 124 cooperating with a latching surface 126 in the bore 106 formed of slots and ridges which engage and latch the shaft against rotation. The springs 114 are tensioned by engaging the screwdriver slot 112 by a screwdriver and pushing it forward to release the latching surfaces. Rotation of the screwdriver tightens or tensions the coil of the spring to adjust the stiffness of the fin.

While I have illustrated and described my invention by means of specific embodiments, it is to be understood that numerous changes and modifications may be made therein without departing from the spirit and the scope of the invention as shown in the appended claims.

I claim:

1. A three dimensional structure defining a watercraft having a buoyancy for traversing a water surface along its longitudinal axis, comprising:

a hull having a lower surface for normal contact with and support of the hull on a body of water;

a fin having an inner end and an outer end, secured at said inner end to said lower surface and extending into said body of water;

hinge means intermediate said inner and outer ends of said fin for enabling an outer portion of said fin to freely pivot during use in either direction from a central position normal to said lower surface within a range of up to no more than about ninety degrees in said either direction about an axis parallel to the longitudinal axis of said watercraft.

2. A watercraft according to claim 1 wherein said fin is enabled to pivot at an angle up to about forty-five degrees in either direction from normal to the hull surface.

3. A watercraft according to claim 2 wherein said hinge is about midway between said inner end and said outer end.

4. A watercraft according to claim 2 wherein said hinge is proximate said inner end of said fin.

5. A watercraft according to claim 4 wherein said hinge means includes resilient biasing means for resiliently resisting pivoting of said fin.

6. A watercraft according to claim 1 wherein said hinge means includes shoulder means defining the limits of an angle of pivot of said fin.

7. A watercraft according to claim 1 wherein said hinge means includes resilient biasing means for resiliently resting pivoting of said fin.

8. A watercraft according to claim 1 wherein said hinge means includes locking means for enabling selective locking said fin in a selected angle of pivot from said central position.

9. A three dimensional structure defining a watercraft having a buoyancy for traversing a water surface along its longitudinal axis, comprising:

a hull having a lower surface for normal contact with and support of the hull on a body of water;

a fin having an inner end and an outer end, secured at said inner end to said lower surface and extending into said body of water;

hinge means intermediate said inner and outer ends of said fin for enabling an outer portion of said fin to freely pivot during use in either direction from a central position normal to said lower surface about an axis parallel to the longitudinal axis of said watercraft for enabling increased controllability of said watercraft wherein said binge means includes spring means for resisting pivoting of said fin from a neutral position.

10. A watercraft according to claim 9 wherein said fin is enabled to pivot at an angle up to about forty-five degrees from normal to the hull surface.

11. A three dimensional structure according to claim 10 wherein said hinge means includes resilient biasing means resiliently resisting pivoting of said fin.

12. A watercraft according to claim 11 wherein said hinge is about midway between said inner end and said outer end.

13. A watercraft according to claim 11 wherein said hinge is proximate said inner end of said fin.

14. A three dimensional structure defining a surfboard having a buoyancy for supporting a load and for traversing a water surface generally along the longitudinal axis of said surfboard, comprising:

a hull having a lower surface for normal contact with and support of the hull on a body of water and a upper surface defining a generally planar deck;

a fin having an inner end and an outer end, secured at said inner end to said lower surface for extending into said body of water; and hinge means intermediate said inner and outer ends of said fin for enabling an outer portion of said fin to freely pivot during use an equal angle in either direction within a range of up to no more than about ninety degrees from a central position normal to said lower surface about an axis parallel to the longitudinal axis of said watercraft.

15. A watercraft according to claim 14 wherein said fin is enabled to pivot at an angle up to about forty-five degrees from normal to the hull surface.

16. A watercraft according to claim 15 wherein said hinge is about midway between said inner end and said outer end.

17. A watercraft according to claim 15 wherein said hinge is proximate said inner end of said fin.

18. A watercraft according to claim 15 wherein said hinge means includes locking means for enabling selective locking said fin in a selected angle of pivot from said central position.

19. A three dimensional structure defining a watercraft having a buoyancy for traversing a water surface along its longitudinal axis, comprising:

a hull having a lower surface for normal contact with and support of the hull on a body of water;

a fin having an inner end and an outer end, secured at said inner end to said lower surface and extending into said body of water;

hinge means intermediate said inner and outer ends of said fin for enabling an outer portion of said fin to freely pivot during use in either direction from a central position normal to said lower surface about an axis parallel to the longitudinal axis of said watercraft for enabling increased controllability of said watercraft, said hinge means including resilient biasing means for resiliently resting pivoting of said fin, wherein said resilient biasing means is adjustable.

* * * * *